US006082138A

United States Patent [19]

Meehan

[11] Patent Number: 6,082,138

[45] Date of Patent: Jul. 4, 2000

[54] BODY ORNAMENT

[76] Inventor: Theresa Meehan, P.O. Box 528, Ardmore, Pa. 19003

[21] Appl. No.: 08/980,247

[22] Filed: Nov. 28, 1997

[51] Int. Cl.[7] ..... A44C 7/00

[52] U.S. Cl. ..... 63/14.8; 63/12; 63/14.1; 24/509

[58] Field of Search ..... 63/12, 14.1, 14.8; 24/509, 489, 499, 500, 510; 56/241; 439/506

[56] References Cited

U.S. PATENT DOCUMENTS

| | | | |
|---|---|---|---|
| 93,456 | 8/1869 | Lines | 63/14.8 X |
| 107,679 | 9/1870 | Haberland | 63/14.8 |
| 685,974 | 11/1901 | Cote | 24/507 |
| 1,684,783 | 9/1928 | Spear . | |
| 2,166,533 | 7/1939 | Oettel | 248/231.51 |
| 2,383,448 | 8/1945 | Christy . | |
| 2,869,338 | 1/1959 | Norgaard et al. | 63/12 |
| 3,739,599 | 6/1973 | Lussier . | |
| 4,129,998 | 12/1978 | Ferro | 63/12 |
| 4,411,050 | 10/1983 | Couture | 24/234 |
| 4,625,526 | 12/1986 | Milawski . | |
| 4,987,667 | 1/1991 | Zwart . | |
| 5,125,244 | 6/1992 | Zwart | 63/2 |
| 5,301,393 | 4/1994 | Brown | 24/67.7 |
| 5,803,096 | 9/1998 | Lee | 132/277 |

FOREIGN PATENT DOCUMENTS

| | | | |
|---|---|---|---|
| 133927 | 12/1879 | France | 24/509 |
| 1580355 | 9/1969 | France | 24/509 |
| 19730 | 2/1912 | United Kingdom . | |

OTHER PUBLICATIONS

Hairclip, photos attached, publication date unknown.

*Primary Examiner*—Terry Lee Melius
*Assistant Examiner*—Andrea Chop
*Attorney, Agent, or Firm*—Akin, Gump, Strauss, Hauer & Feld, L.L.P.

[57] ABSTRACT

An ornamentation part and an ornament positioning part are fabricated as a unit to provide a body ornament to be received by and positioned upon a body part; particularly a breast nipple. The positioning part includes a pair of concave spaced arms which form therebetween a body part receiving space of a size and configuration to receive and embrace a body part. The ornamentation part may be an enclosed figure such as a multi-point star, leaf, heart, butterfly, or the like. Further decorations such as feathers, flowers, jewelry, chain links, etc. may be carried by the body ornament as well as loops upon which other decorations may be disposed or from which other decorations may be carried. The ornamentation part and positioning part are sized and configured so that pressure along sides of the ornamentation part effects an enlargement of the positioning part to facilitate an enlargement of a body part space and disposition thereof onto a body part and so that the relaxing of such pressure facilitates disposition of the body ornament on the body part (nipple).

15 Claims, 7 Drawing Sheets

BODY ORNAMENT

BACKGROUND OF THE INVENTION

1. Field of Application

This invention relates to personal ornamentation, jewelry, decorations and the like, and more particularly to such ornamentation, jewelry and decorations which are positioned or carried directly by a body part of a person.

2. Description of the Prior Art

Human beings have been adorning their body parts with jewels, decorations and other ornamentation for centuries. One such common form of body ornamentation are earrings which are directly carried by, hang from, or are otherwise positioned on, an ear or both ears of a person instead of being attached, for instance, to their clothing. It is quite common for persons who desire to wear earrings to have an ear or both ears pierced in one or more places to accommodate positioning the earring or earrings. However, once pierced the person has to position an earring part in the opening through the ear or the opening will close. Piercing of other body parts to attach jewelry, decorations or other ornamentations thereto has also become commonplace. Lips, noses, breast nipples, and other body parts once pierced also require placement of an ornament, decoration or other item through the pierced opening or the opening may close and require re-piercing.

Many people, however, do not wish to have their body parts pierced because of problems with keeping the pierced opening open. There are also concerns with possible health hazards due to having a pierced body part, from the body part piercing, and possible discomfort from either always wearing an ornament or whatever is utilized to keep the pierced opening open.

There are, however, earrings which do not require piercing the ear to facilitate wearing an earring. Clip-like or clasp-like arrangements such as those shown and described in U.S. Pat. No. 1,684,783 patented to R. Spear on Sep. 18, 1928 for "Ear Ornament"; in U.S. Pat. No. 2,383,448 patented on Aug. 28, 1945 to C. Christy for "Ear Ornament"; in U.S. Pat. No. 3,739,599 patented on Jun. 19, 1923 to A. Malone for "Resilient Earring Including Means Limiting Pressure On the Ear Lobe"; and in British Letters Patent Number 19,730 patented on Feb. 1, 1912 to A. Halliday for "Improvements In Or Relating To Earrings", are known. However, all of these arrangements require the use of body gripping members which engage the body part over a relatively small area and which, therefore, may apply an unacceptable positioning pressure to the body part that results in discomfort to the wearer. Moreover, these body part gripping arrangements are peculiar to earrings and would most likely be unacceptable to position an ornament or decoration on other body parts such as breast nipples.

Examples of body decoration or ornamentation, particularly for positioning on the nipple of a person's breast, are shown and described in U.S. Pat. No. 4,987,667 patented to H. Zwart on Jan. 29, 1991 for "Method of Decorative A Human Breast" and in U.S. Pat. No. 5,125,244 patented on Jun. 30, 1992 to H. Zwart for "Nipple Ring For Decorating A Human Breast". Both of these patents require use of a clamping collar of the type shown and described in U.S. Pat. No. 4,107,824 patented to M. Lussier on Aug. 22, 1978 for "Clamping Collar" which encircles the nipple and may apply too much pressure around the entire nipple. Human breast nipples, like other human body parts, differ in size and shape. The Zwart nipple ring may prove unacceptable because if the smallest size to which the ring closes is still larger than the particular nipple upon which it is to be positioned the ring will fall off; and if the nipple ring closes to a size smaller than the users nipple then possible unacceptable pressure will be applied around the entire nipple creating discomfort to the wearer and/or distortion of their nipple's shape. In addition, squeezing the end pieces of the Zwart devices between ones fingers and manipulating the device over a nipple while resisting the built in spring effect to close the opening may prove to be troublesome and thus render the type of decoration and positioning unacceptable. D. Milawski, on the other hand, in U.S. Pat. No. 4,625,526 patented on Dec. 2, 1986 for "Nipple Decoration Device" provides spring biased arcuate pads for positioning a decoration on a human breast nipple. Here again the possible separation between the arcuate pads if too small may create a painful experience and if too large will result in the decoration not being properly positioned. Moreover, keeping the pads separated while positioning the device on a nipple appears to create some degree of difficulty. Separating the pads once the device is in place may present even greater problems. Also, once in position the weight of the tubular member, springs and pads will tend to pull the device off the nipple.

SUMMARY OF THE INVENTION

It is, therefore, an object of this invention to provide new and novel body ornaments.

It is another object of this invention to provide new and novel positioning members for positioning a body ornament on a body part.

It is still another object of this invention to provide new and novel ornamentations and decorations for a human breast and more particularly its nipple.

It is yet still another object of this invention to provide new and novel positioning members for positioning a body ornamentation or decoration on a human breast particularly the nipple thereof.

It is a further object of this invention to provide new and novel nipple decorations and ornamentations wherein the positioning member forms part of the decoration or ornamentation.

It is yet still a further object of this invention to provide new and novel nipple decorations and ornaments wherein an ornament part coacts with a positioning part to facilitate position the device on a body part such as a breast nipple.

It is yet still a further object of this invention to provide new and novel positioning devices for body ornaments and decorations.

Other objects, features and advantages of the invention in details of construction and arrangement of parts will be seen from the above and from the following description of the preferred embodiments when considered with the drawing and from the appended claims.

DESCRIPTION OF THE PREFERRED EMBODIMENTS

Figure 1:
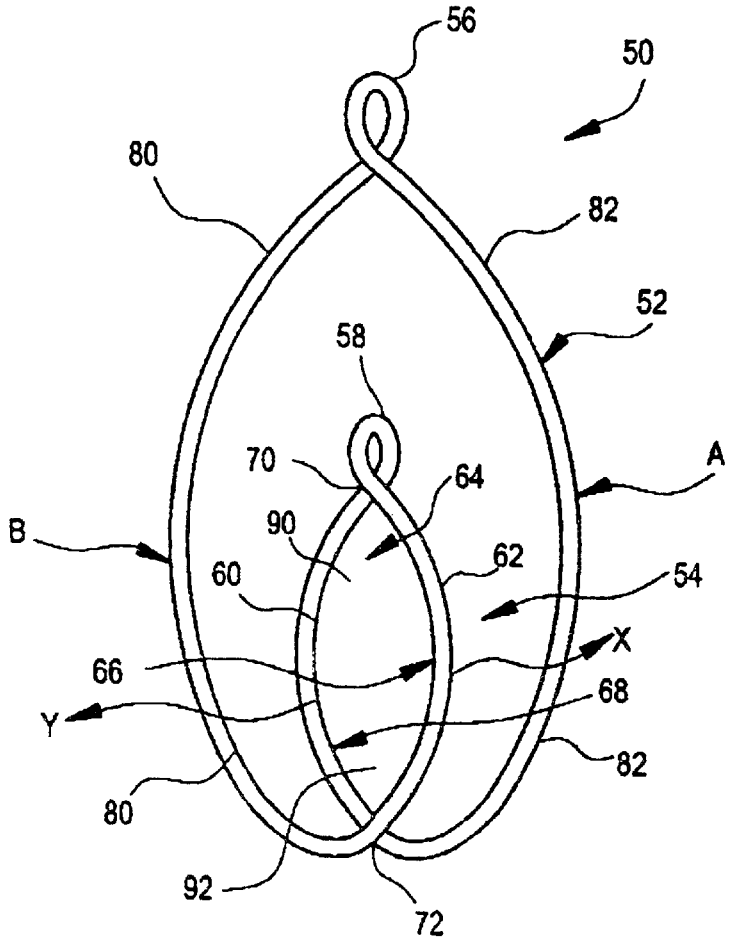
FIG. 1 is a plan view of a body ornament incorporating the instant invention.

With reference to FIG. 1 there is generally shown at 50 a body ornament incorporating the instant invention. Ornament 50 is preferably fabricated from wire which may be round, square or relatively flat in cross-sectional configuration and which may be silver, gold, jewelers metal or any other suitable wire stock. Ornament 50 may be otherwise fabricated as long as it includes at least an ornament part 52 having a selected outer peripheral configuration and a positioning part or member 54.

Ornament part 52 may be either continuous or open at ends (not shown) and may be of many possible peripheral shapes and configurations depicting familiar natural and improvised shapes and figures as will be hereinafter described in further details with respect to this and other embodiments of this invention. Ornament part 52 (FIG. 1), for example, may be considered to be of a simple leaf design for ornament 50 and may terminate in a loop 56 upon which or from which other ornamentation or decoration such as jewels, precious stones, chains, or the like may be mounted or hung. A similar loop 58 is disposed at a distal end of positioning member 54, for similar purposes if so desired.

Positioning member 54 includes a first or left-side arm 60 and a second or right-side arm 62 which face each other to form an oval shaped opening 64 with side walls 66, 68 each of concave configuration. Arms 60, 62 cross over each other at oval ends 70, 72. By applying pressure against sides 80, 82 of ornament part 52 in the directions of arrows A and B (FIG. 1) sides 80, 82 will move towards each other and effect a movement of side walls 66,68 of positioning part 54 in the direction of arrows X and Y away from each other to enlarge opening 64. When so enlarged positioning member 54 may be placed about a nipple with relative ease and so that the nipple is disposed within space 64. By relaxing the pressure against sides 80, 82 side walls 66, 68 will again move towards each other softly embracing the nipple to position body ornament 50 thereon without applying undue pressure against or about the nipple. It should be noted that when ornament 50 is so disposed on a nipple that upper and lower areas of the nipple will be free to move into end positions 90, 92 of space 64 of ornament positioning member 54. Of significant importance is that sides 80, 82 of ornament part 52 are more easily grasped, either between the users fingers or within the palm of their hand, while enlarging nipple space 64, while positioning ornament 50 about the nipple and while relaxing the pressure on sides 80, 82 to position device 50 in place and with side-walls 60, 62 of positioning part embracing the body part (nipple).

The material selected for ornament 50 is a resilient type wire, possible with flat surfaces for side-walls 60, 62, and without sharp edges and so that it will flex when sides 80, 82 are moved towards each other and return to shape when pressure against sides 80, 82 is relaxed; and further so that it will assume its position on the wearers nipple (or other body part). The merging of sides 80, 82 of ornament part 50 into side walls 66, 68 at end 72 is effective to facilitate the opening and closing of space 64.

Ornament part 52 and positioning part 54 are preferably formed integral and unitary and of the same material. They may, however, be fabricated separately and suitably secured together so as to function as described.

Figure 2:
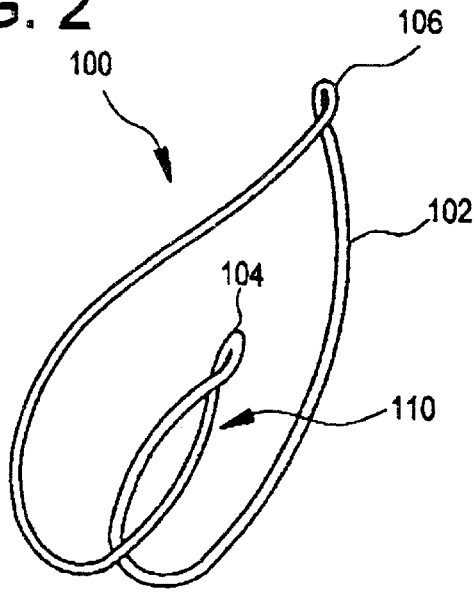
FIG. 2 is a plan view of an alternative embodiment of a body ornament incorporating the instant invention.

Body ornament 100 of FIG. 2 is fabricated similar to body ornament 50 of FIG. 1 except that its ornament part 102 has an outer peripheral configuration formed into a leaf-like configuration different from that of ornament 50 of FIG. 1. Loops 104, 106 are formed for ornament 100 to facilitate disposing decorative items (jewels, etc.) At these locations. A positioning part or member 110 is provided for ornament 100 similar in configuration and operation to positioning member 54 of ornament 50.

Figure 3:
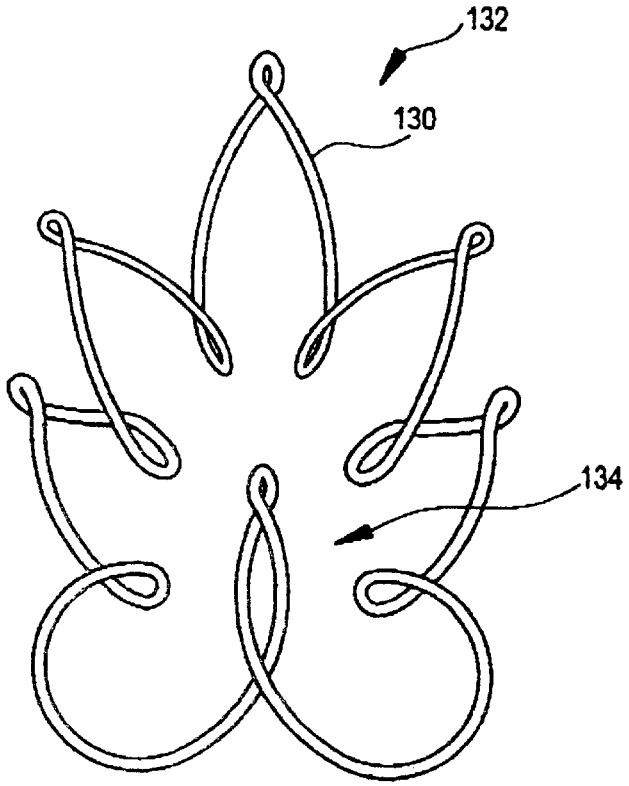
FIGS. 3, 4 and 5 show alternate embodiments of body ornaments incorporating the instant invention and which show, by way of examples, the instant invention with leaf-like, heart-like and butterfly-like ornamentations respectively.
Figure 4:
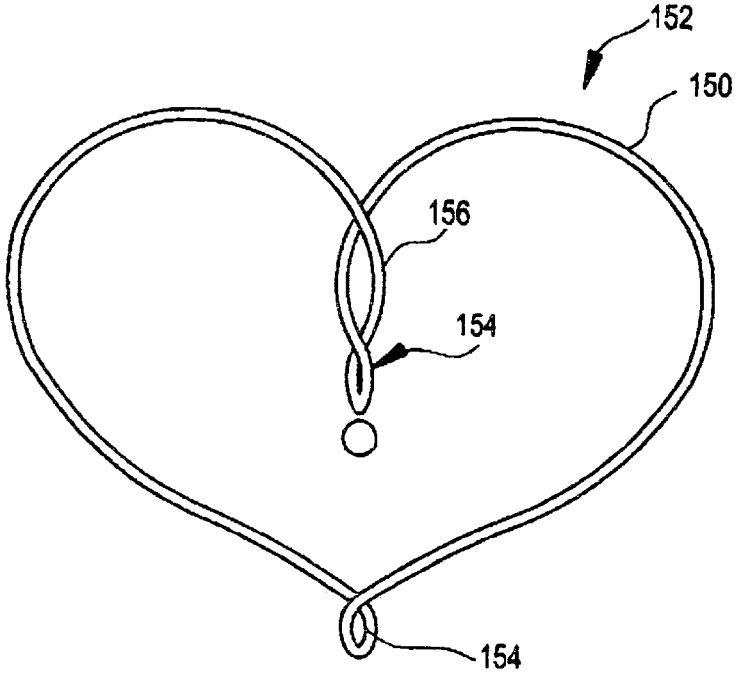
Figure 5:
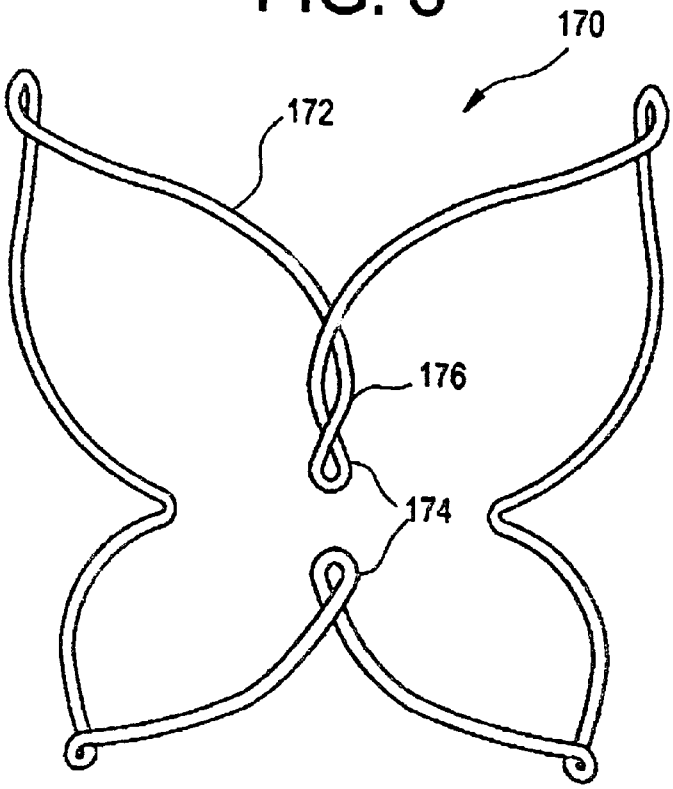

In the embodiment of FIG. 3 the outer peripheral configuration of ornament part 130 of body ornament 132 is that of a fancier leaf-like design. Ornament 132, however, also includes a positioning part or member 134 sized and configured like positioning members 54 of FIG. 1 and 110 of FIG. 2. In the embodiment of FIG. 4 the outer peripheral configuration of part 150 of ornament 152 is that of a heart while in the embodiment of FIG. 5 the outer peripheral configuration of ornament part 170 for body ornament 172 simulates a butterfly. Both body ornaments 150 and 170 are fabricated from materials and as described above for the body ornaments of FIGS. 1 thru 3. Each body ornament 152, 172 includes loops 154, 174 that will accept other decorations, if desired, and positioning parts 156, 176 respectively that are fabricated and which function the same as the positioning parts of the embodiments of FIGS. 1–3.

Figure 6:
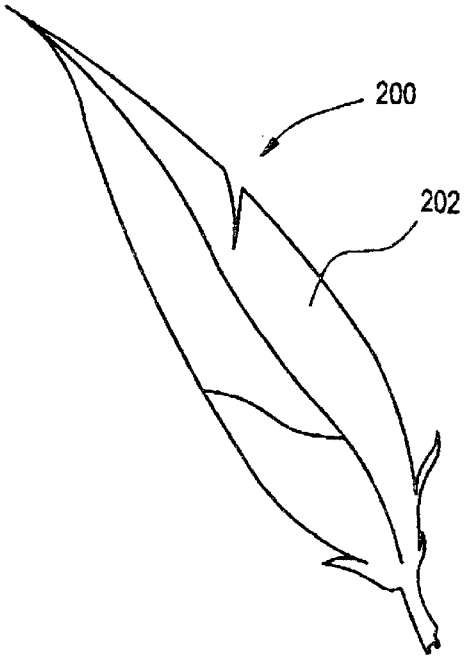
FIG. 6 is a plan view of yet another embodiment of body ornamentation incorporating the instant invention in the configuration of a long-leaf arranged upon the ornament of FIG. 1.
Figure 7:
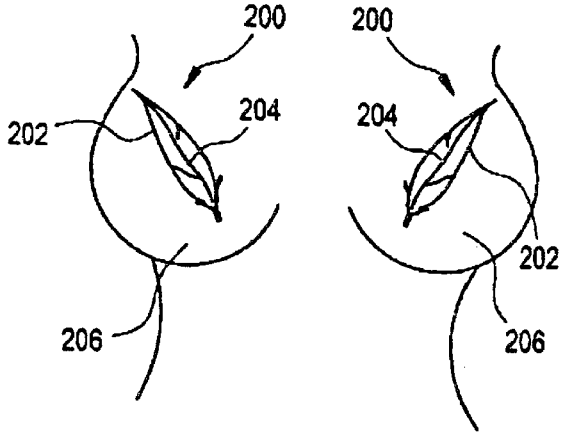
FIG. 7 is a schematic of a pair of body ornaments of FIG. 6 as they might be positioned upon the nipples of human breasts.

Body ornament 200 (FIGS. 6 and 7) includes a feather-like covering 202 of either natural (which could be a real feather) or synthetic material carried by a base body ornament such as body ornament 50 (FIG. 1) or 100 (FIG. 2). The feather covering is affixed to or otherwise carried by outer peripheral sides (not shown but such as sides 80, 82 of ornament 50—FIG. 1. The positioning members (not shown but the same as members 54—FIG. 1 and 110—FIG. 2) are utilized as described for the positioning members of the embodiments of FIGS. 1–5. FIG. 7 shows a pair of body ornaments 200 each positioned on a nipple 204 of a persons breasts 206.

Figure 8:
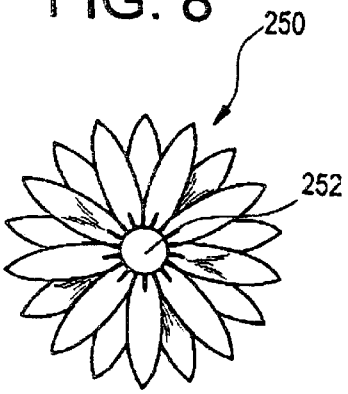
FIG. 8 is a plan view of yet another embodiment of body ornamentation, incorporating the instant invention, in the configuration of a silk flower arranged upon the ornamentation of FIG. 2.
Figure 9:
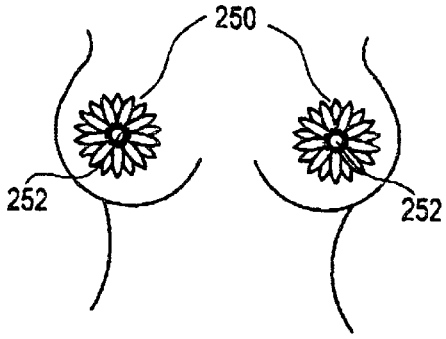
FIG. 9 is a schematic of a pair of body ornaments of FIG. 8 as they might be positioned upon the nipples of human breasts.

In the embodiment of FIGS. 8 and 9 a body ornament 250 in the configuration of a silk flowers fabricated from suitable materials is carried by a base body ornament such as ornaments 50, 100, or 152 of FIGS. 1, 2, or 4, respectively.

Each body ornament 250 includes a positioning part or member (not shown but the same as either positioning member 54—FIG. 1 or positioning member 110) to facilitate positioning body ornament 250 on the nipples 252 of a persons breasts.

Figure 10:
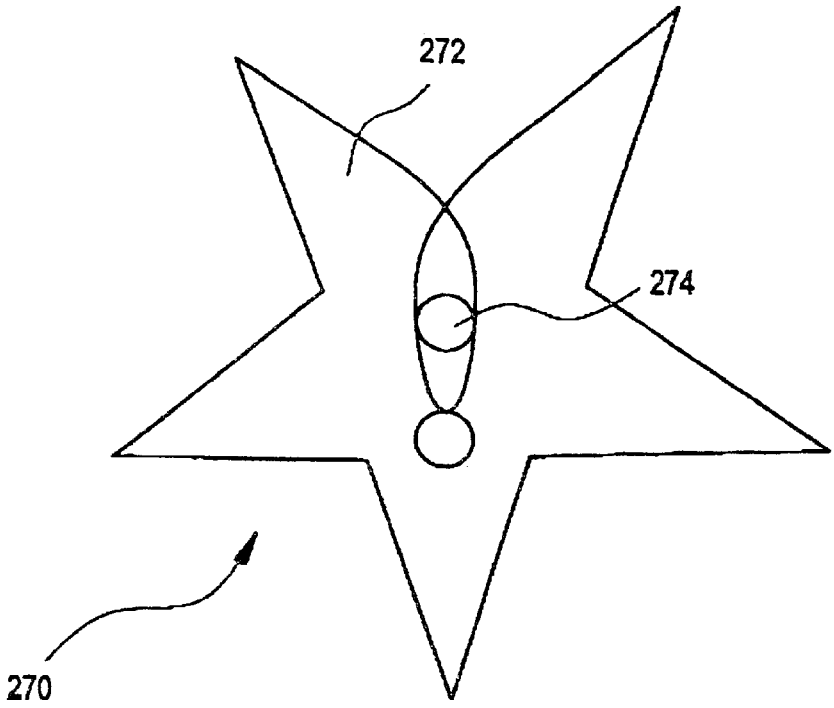
FIGS. 10 and 11 show still other alternative embodiments of body ornaments incorporating the instant invention and which show, by way of example, the instant invention with a five pointed and eight pointed star-like ornamentation respectively.
Figure 11:
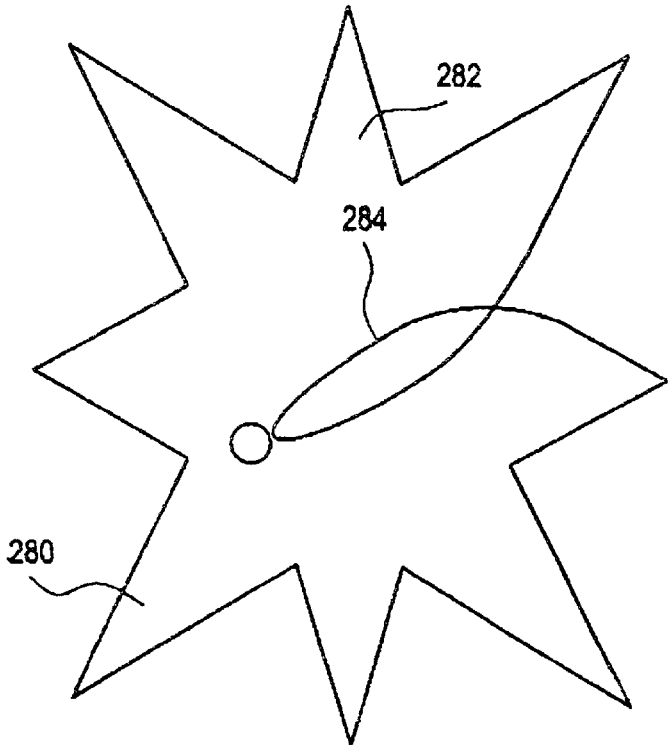

Body ornaments 270, 280 respectively of FIGS. 10 and 11 each have their ornament parts 272, 282 respectively in the configuration of multi-pointed stars. These body ornaments are each formed of materials as described for body ornaments 50 (FIG. 1) and 100 (FIG. 2) and each include a positioning part or member 274, 284 (FIGS. 10 and 11) respectively which is fabricated and functions as described above for positioning members 54 (FIG. 1) and 110 (FIG. 2).

Figure 12:
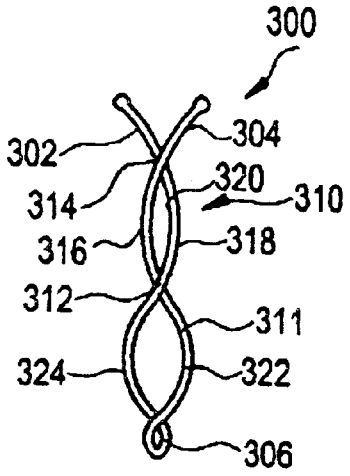
FIGS. 12, 13, 14 and 15 show plan views of yet other alternative embodiments of body ornamentation incorporating the instant invention.

FIG. 12 shows an alternative embodiment of body ornament 300 fabricated from a length of material folded back upon itself to provide a pair of arms 302, 304 connected together at a loop 306. The material for ornament 300 is the same as the materials described above for ornament 50 of FIG. 1. Loop 306 may be of a size and configuration to support a decoration such as a precious or semi-precious jewel or a pendant attached directly to loop 306 or suspended by a suitable chain therefrom.

A positioning part or member 310 is provided for an ornament part 311 of body ornament 300 by crossing arms 302, 304 first at a location 312 and then at a location 314 to form between walls 316, 318 thereof a nipple space 320. Ornament 300 is utilized in a manner similar to that described above for the embodiments of FIGS. 1–11. When sides 322, 324 of arms 302, 304 are pressed towards each other, walls 316, 318 of positioning part 310 move apart to facilitate placement of ornament 300 on a persons nipple (not shown). Nipple space 320 and walls 316, 318 are sized and configured so that the nipple is softly gripped when sides 322, 324 are released, in a manner that will not be uncomfortable to the wearer but which is sufficient to maintain body ornament 300 in place. The oval configuration of positioning member 310 and the concave configuration of its wall 316, 318 facilitate a tender grip along only a part of opposing sides of a nipple without an uncomfortable encircling of the entire nipple.

Figure 13:
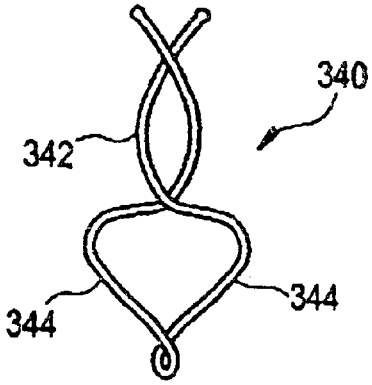
Figure 14:
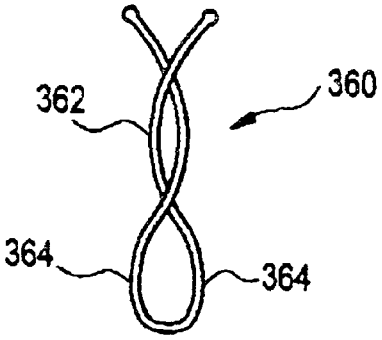
Figure 15:
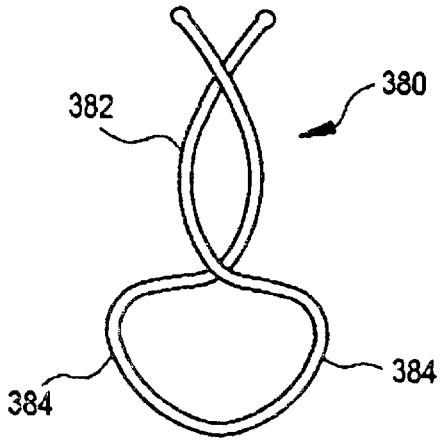

The alternative embodiments of body ornaments 340 (FIG. 13), 360 (FIG. 14) and 380 (FIG. 15) are also fabricated from a single length of material and so as to include positioning parts or members 342, 362, 382 respectively and ornament part sides 344, 364, 384 respectively. The materials and fabrication for ornaments 340, 360, 380 are as described above for ornament 300 (FIG. 12) and the operation of positioning members 344, 364, 384 thereof are the same as for positioning member 310 of the embodiment 300 (FIG. 12). Strands of chain or rope 346 (FIG. 13) of precious or semi precious metals such as gold, silver or the like, may be suspended from a loop 348 of these ornaments. In addition, beads, pearls or similar items 350 may be strung on to the ornament parts as shown in FIG. 13 or such other location as may be desired.

Body ornament 400 (FIG. 16) also utilizes a single strand of material (of the type and configuration described above for other body ornament embodiments). The material is folded over upon itself to form a pair of spaced and opposed arms 402, 404 each terminating at the tip 406, 408 respectively and each configured to include a first positioning part 410 and a secured positioning part 412. Positioning parts or members 410, 412 each include a first nipple space 414 defined between concave sides 416, 41 8 and a second nipple space 420 defined between concave sides 422, 424. Ornament part 426 includes an operator 430 provided for body ornament 400 so that when walls 432, 434 thereof are pressed towards each other the spacing within positioning parts 410 and 412 will increase so that the persons nipple may be placed in either nipple space 414 or nipple space 420. When pressure is released from walls 432, 434 the sides of the nipple spaces will move towards each other to position body ornament 400 upon a persons nipple. The materials utilized to fabricate body ornament 400 are similar to those described above for the other described body ornaments.

Figure 16:
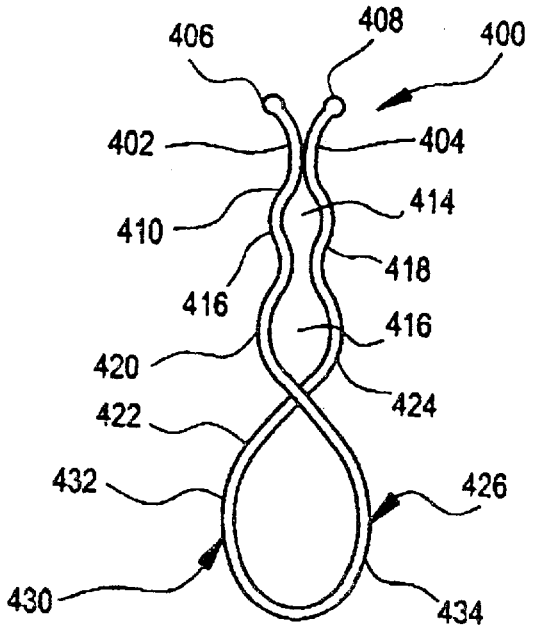
FIGS. 16, 17 and 18 show plan views of yet still other alternative embodiments of body ornamentation incorporating the instant invention.
Figure 17:
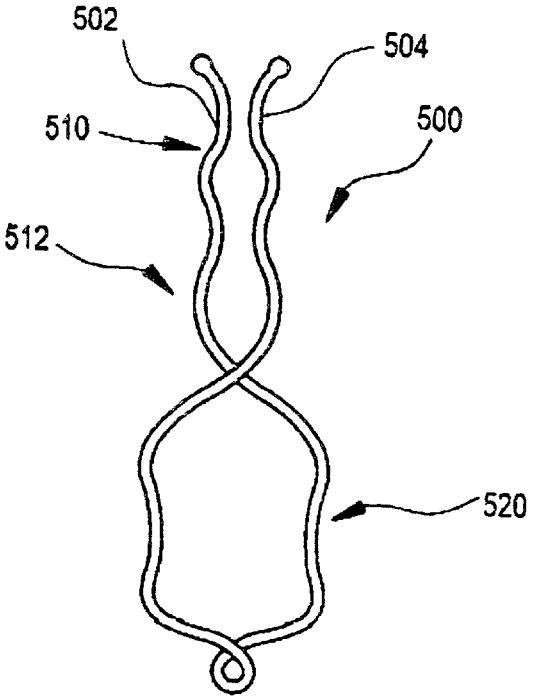
Figure 18:
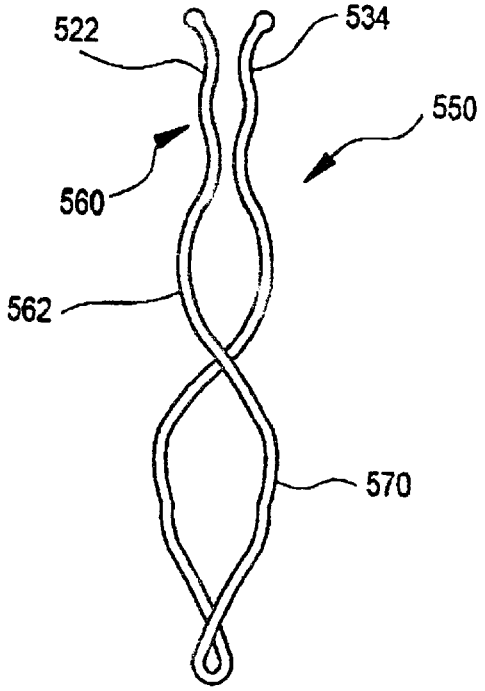

Body ornaments 500 (FIG. 17) and 550 (FIG. 18) are similar in construction and operation to that of body ornament 400 of FIG. 16 except that the respective arms 502, 504 and 552, 554 are configured as shown in the respective figures. Each embodiment, like that of FIG. 16, includes a first positioning part or member 510, 560 and a second positioning part or member 512, 562 as well as an operator 520, 570 respectively included as part of the ornament part.

In all of the described embodiments the configuration and sizing of the ornament part in relation to the positioning part and the co-action between them is such that the movement of sides of the ornament part, by either the users fingers or by action of the users hand, will effect either enlargement of the body part (nipple) space and reduction of same once the body ornament has been positioned thereon. That same coaction between ornament part and positioning part also facilitates disposition of the body ornament on the body part (nipple) with relative ease; the embracing of the body part by the walls of the positioning part; and the removal of the body ornament from the body part.

Figure 19:
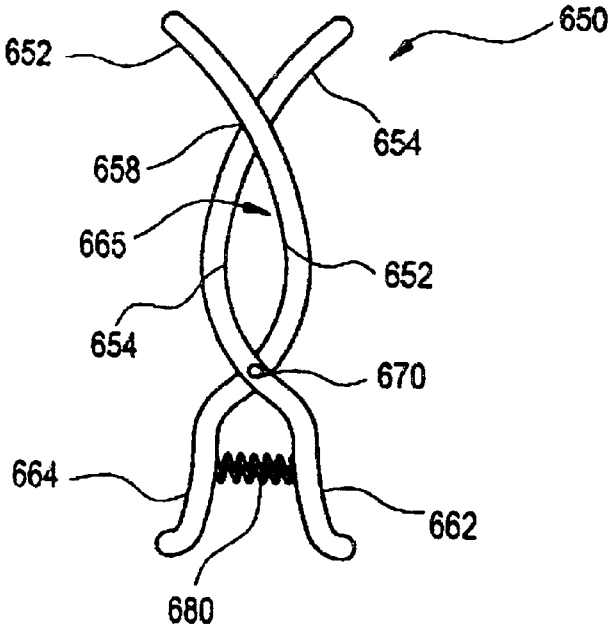
FIG. 19 is a plan view of a further embodiment of a body ornament incorporating the instant invention.

Another alternative positioning part 650, incorporating the instant invention, is shown in FIG. 19. Part 650 includes a pair of arms 652, 654 which are pivotally connected together at 670. Arms 652, 654 cross-over at 658 and, as such provide a pair of facing concave surfaces 660, 662 which form therebetween a nipple space 665.

Extensions 664, 662 of arms 654, 652, respectively include therebetween a spring device 680 which urges extensions 664, 662 apart and pivots arms 652, 654 into the position thereof shown in FIG. 19. When extensions 664, 662 are pressed towards each other, arms 654, 652 pivot apart and permit placement of positioning part 650 upon a nipple so that the nipple is softly disposed within nipple space 665 as described above for the previously described positioning parts.

Positioning part 650 is also fabricated from materials as described above for the previously described positioning parts and is to be fabricated into ornament parts such as those described herein. Arms 654 and 652 as well as their respective extensions 664, 662 may also be cast.

It will be appreciated that the body part space engaged by the arms may grasp not only the nipple but also may be used to grasp other adjacent parts of the body for firmer securing if the user deems it appropriate.

From the above description it will thus be seen that there has been described and shown new and novel body ornaments and positioning parts which facilitate positioning of the body ornaments on the nipples of a person in such a way as not to capture and enclose the entire nipple and so as not to apply undue pressure thereto.

It is understood that although there has been shown and described the preferred embodiments of the invention that various modifications may be made in the details thereof without departing from the spirit as comprehended by the following claims.

What is claimed is:

1. A body ornament comprising:

a first positioning arm having first and second portions;

a second positioning arm having first and second portions, the first portion of the first positioning arm being connected to the first portion of the second positioning arm, the first positioning arm crossing over the second positioning arm at a first cross-over and at a second cross-over, the first and second positioning arms forming a one-piece, continuous loop; and a generally elongated loop being formed between the first cross-over and the second cross-over, the loop being sized to form therein a body part receiving space, wherein the second portions of the first positioning arm and the second positioning arm are movable between a first, relaxed position wherein the loop is a first size and a second position wherein the loop is a second size which is larger than the first size, said second portions being biased toward the first position.

2. The body ornament of claim 1 further including a decoration part carried by at least one of the first positioning arm, the second positioning arm and the loop.

3. The body ornament of claim 1 wherein the loop is adapted to position the body ornament on a person's body part and so as to embrace the body part.

4. The body ornament of claim 3 wherein the loop is adapted to position the body ornament on a person's breast nipple so as to embrace the breast nipple.

5. The body ornament of claim 1 wherein the first positioning arm and the second positioning arm between the first and second cross-overs each have a concave surface disposed to face and are spaced from each other to form therebetween the body part receiving space.

6. The body ornament of claim 1 wherein the first positioning arm and the second positioning arm are configured and coact so that the application of pressure against the second portions of the first and second positioning arms effects an enlarging of the loop from a first size to a second size and so that relaxing of pressure against the second portions of the first and second positioning arms shrinks the loop from the second size to the first size.

7. A body ornament for decorating a human breast, the ornament comprising:

a first singular positioning arm having first and second portions;

a second singular positioning arm having first and second portions, the first portion of the first positioning arm crossing over the first portion of the second positioning arm at a cross-over, the first positioning arm being pivotally connected to the second positioning arm at a pivot between the cross-over and the second portions of the first and second positioning arm. wherein the first portions of the first and second positioning arms extend beyond the cross-over in a direction opposite the pivot and the cross-over; and a generally elongated loop being formed between the cross-over and the pivot, the loop being adapted to form therein a body part receiving space, wherein the first positioning arm and the second positioning arm between the cross-over and the pivot are biased toward each other.

8. The body ornament of claim 7 wherein the first and second positioning arms are biased by a spring.

9. The body ornament of claim 1 wherein the spring acts in a linear direction.

10. The body ornament of claim 7 further including a decoration part carried by at least one of the first positioning arm, the second positioning arm and the loop.

11. The body ornament of claim 7 wherein the loop is adapted to position the body ornament on a person's body part and so as to embrace the body part.

12. The body ornament of claim 11 wherein the loop is adapted to position the body ornament on a person's breast nipple so as to embrace the breast nipple.

13. The body ornament of claim 7 wherein the first positioning arm and the second positioning arm between the cross-over and the pivot each have a concave surface disposed to face and are spaced from each other to form therebetween the body part receiving space.

14. A body ornament for decorating a human breast, the ornament comprising:

a first positioning arm having a first portion and a second portion;

a second positioning arm having a first portion and a second portion, the first positioning arm being connected to the second positioning arm at a connection, the first positioning arm crossing over the second positioning arm at a cross-over, the first portions of the first and second positioning arms being spaced apart by a distance, the first and second positioning arms forming a one-piece, continuous loop; and a generally elongated loop being formed between the cross-over and the connection, wherein a nipple of a human breast is receivable within a concave body part receiving space formed between the first positioning arm and the second positioning arm between the cross-over and the first portions.

15. The body ornament of claim 14 wherein the distance between the first portions of the first and second positioning arms is adapted to position the body ornament on a person's body part and so as to embrace the body part.

* * * * *

UNITED STATES PATENT AND TRADEMARK OFFICE

CERTIFICATE OF CORRECTION

PATENT NO. : 6,082,138
DATED : July 4, 2000
INVENTOR(S) : Theresa Meehan

It is certified that error appears in the above-identified patent and that said Letters Patent is hereby corrected as shown below:

In the drawings, please replace Fig. 19 with the one shown below:

FIG. 19

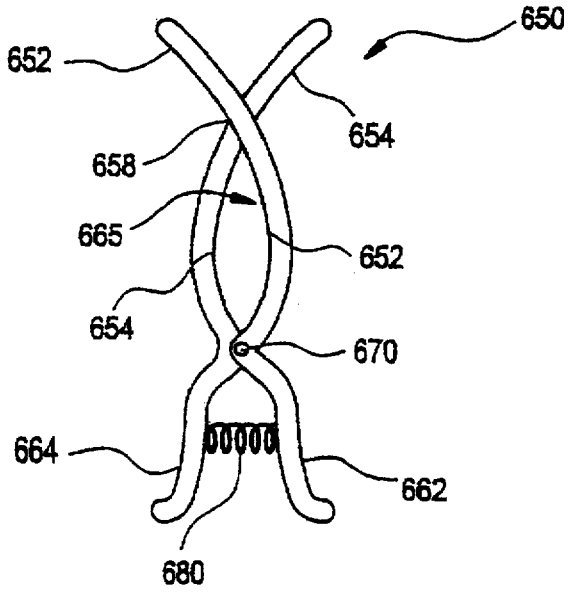

Signed and Sealed this

Fourteenth Day of August, 2001

*Attest:*

Nicholas P. Godici

*Attesting Officer*

NICHOLAS P. GODICI
*Acting Director of the United States Patent and Trademark Office*